US008767372B2

(12) United States Patent
Stifel et al.

(10) Patent No.: US 8,767,372 B2
(45) Date of Patent: Jul. 1, 2014

(54) CORONA IGNITION DEVICE

(75) Inventors: Timo Stifel, Korntal-Muenchingen (DE); Thomas Giffels, Stuttgart (DE); Axel Mueller, Weimar (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 290 days.

(21) Appl. No.: 13/329,587

(22) Filed: Dec. 19, 2011

(65) Prior Publication Data

US 2013/0155570 A1 Jun. 20, 2013

(30) Foreign Application Priority Data

Dec. 21, 2010 (DE) ..... 10 2010 055 570

(51) Int. Cl.
*F23Q 3/00* (2006.01)
*H01F 27/02* (2006.01)
*F02P 17/00* (2006.01)

(52) U.S. Cl.
USPC ..... 361/263; 336/96; 324/396

(58) Field of Classification Search
USPC ..... 361/263
See application file for complete search history.

(56) References Cited

U.S. PATENT DOCUMENTS

| | | | | |
|---|---|---|---|---|
| 3,882,341 | A | 5/1975 | Green | |
| 4,384,256 | A * | 5/1983 | Di Monte | 324/396 |
| 4,841,925 | A | 6/1989 | Ward | |
| 5,929,736 | A * | 7/1999 | Sakamaki et al. | 336/96 |
| 6,668,810 | B1 | 12/2003 | St. John et al. | |
| 8,342,147 | B2 * | 1/2013 | Nouvel et al. | 123/143 B |
| 2003/0183218 | A1 | 10/2003 | Maekawa et al. | |
| 2004/0129241 | A1 | 7/2004 | Freen | |
| 2009/0188458 | A1 | 7/2009 | Visser et al. | |
| 2012/0249006 | A1 * | 10/2012 | Burrows | 315/209 T |

FOREIGN PATENT DOCUMENTS

EP 1 515 594 A2 3/2005

* cited by examiner

*Primary Examiner* — Jared Fureman
*Assistant Examiner* — Lucy Thomas
(74) *Attorney, Agent, or Firm* — Hackler Daghighian & Martino

(57) ABSTRACT

The invention relates to an ignition device for igniting fuel in an internal combustion engine by generating a corona discharge, comprising an insulator which carries a center electrode, a coil attached to the center electrode, the coil being wound onto a bobbin and enclosed by a tube housing. According to the invention, the coil tapers toward the insulator.

13 Claims, 1 Drawing Sheet

CORONA IGNITION DEVICE

The invention is directed to a corona ignition device. Such ignition devices are also referred to as HF ignition devices and are known from EP 1 515 594 A2, for example.

A method for igniting fuel in a combustion chamber of an internal combustion engine by way of a corona discharge produced in the combustion chamber is also described in U.S. 2004/0129241 A1. A center electrode held by an insulator is used, which forms a capacitance together with an outer conductor enclosing the insulator or with the walls of the combustion chamber at ground potential, as counter electrode. The insulator enclosing the center electrode and the combustion chamber with the contents thereof act as a dielectric. Air or a fuel/air mixture or exhaust gas is located therein, depending on which stroke the piston is engaged in.

This capacitance is a component of an electric oscillating circuit which is excited using a high-frequency voltage which is created, for example, using a transformer having a center tap. The transformer interacts with a switching device which applies a specifiable DC voltage to the two primary windings, in alternation, of the transformer separated by the center tap. The secondary winding of the transformer supplies a series oscillating circuit having the capacitance formed by the center electrode and the walls of the combustion chamber. The frequency of the alternating voltage which excites the oscillating circuit is controlled such that it is as close as possible to the resonance frequency of the oscillating circuit. The result is a voltage step-up between the ignition electrode and the walls of the combustion chamber in which the ignition electrode is disposed. The resonance frequency is typically between 30 kilohertz and 5 megahertz, and the alternating voltage reaches values at the ignition electrode of 10 kV to 500 kV, for example. A corona discharge can therefore be created in the combustion chamber.

Corona ignition devices are an alternative to conventional ignition systems which induce ignition using an arc discharge at a spark plug and are subject to considerable wear due to electrode erosion. Corona ignition devices have the potential to achieve a longer service life, although they have not achieved this yet.

The problem addressed by the invention is therefore that of demonstrating a way to improve the service life of a corona ignition device.

SUMMARY OF THE INVENTION

This problem is solved by an ignition device having the features listed in claim 1, and by an ignition device having the features of claim 12. Advantageous refinements of the invention are the subject matter of dependent claims.

In operation of corona ignition devices with frequencies of typically at least 1 MHz and voltages of a few kV, the dielectric strength has proven problematic. Voltage overloads and partial discharges often cause the ignition device to fail prematurely. Within the scope of the invention it was found that the risk of voltage overloads can be significantly reduced by inserting a metal cap onto an end section of the bobbin facing the insulator. Such a metal cap provides electromagnetic shielding of the coil end and thereby reduces the risk of voltage overloads and partial discharges.

The metal cap preferably rests against at least one winding of the coil. The metal cap can cover a few windings of the coil or terminate upstream of the coil. It is therefore advantageous when the metal cap extends at least to, or even covers the coil end. Preferably the metal cap tapers toward the cap end facing away from the insulator, i.e. toward the coil. In this manner the field distribution at the end of the metal cap can be evened out further, thereby reducing the risk of voltage overloads.

Field peaks at the end of the coil, which can result in insulation problems, can also be reduced by tapering the coil toward the insulator. This can be reduced with minimal effort by winding the coil on a bobbin which comprises a section which tapers toward the insulator. Windings on the tapering section of the bobbin then have a diameter that becomes smaller the more closely the insulator is approached.

Field peaks at the coil end, which is at particular risk for voltage overloads, can be largely prevented by using a coil winding that tapers toward the insulator, i.e. by an outer diameter of the winding that decreases toward the insulator. An ignition device according to the invention therefore has a longer service life.

It is particularly advantageous to combine the two measures according to the invention, i.e. a coil tapering toward the insulator and a metal cap inserted onto the bobbin, since a particularly significant improvement can be achieved in this manner. Preferably, the metal cap covers a tapering section of the bobbin. The service life of the ignition device can be markedly improved by using only one of these two measures, however.

The outer contour of the metal cap preferably tapers continuously toward the coil. The tapering preferably begins tangentially with a larger radius of curvature on the outer jacket surface toward a smaller radius of curvature on the end face. An advantageous contour can be achieved, for example, by an ellipse or tangential transitions of a plurality of radii.

BRIEF DESCRIPTION OF THE DRAWINGS

Further details and advantages of the invention are explained using an embodiment, with reference to the attached drawings. They show.

DETAILED DESCRIPTION

Figure 1:
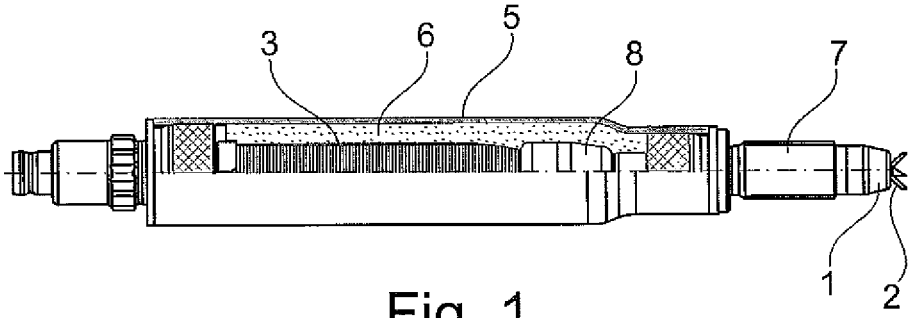
FIG. 1 an embodiment of an ignition device according to the invention.
Figure 2:
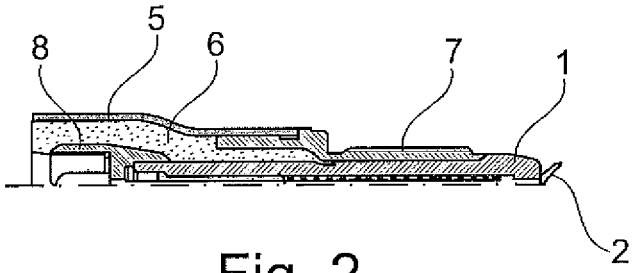
FIG. 2 a detail of the ignition device in a sectional view.
Figure 3:
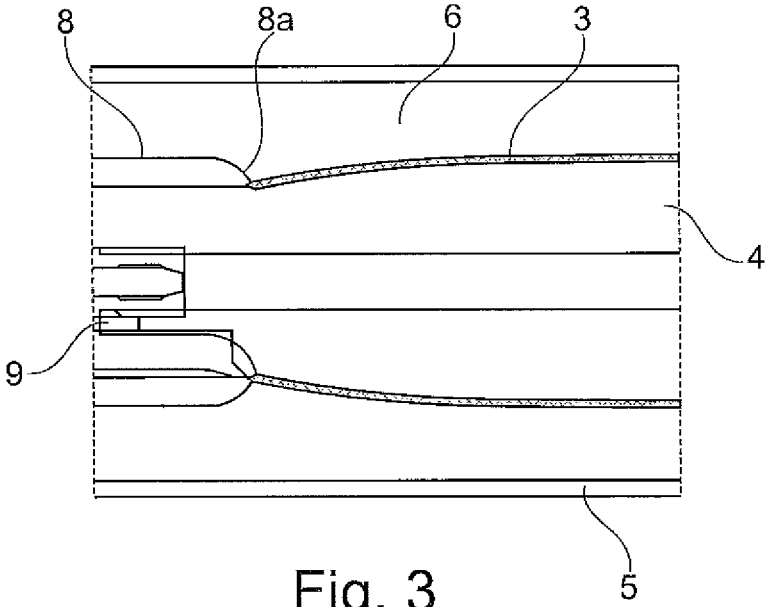
FIG. 3 a further detailed view of the ignition device, in a cross section.

FIG. 1 shows, in a partially exposed view, an embodiment of an ignition device for igniting fuel in an internal combustion engine by producing a corona discharge. FIGS. 2 and 3 each show cross-sectional detailed views of the ignition device.

The ignition device comprises an insulator 1 which carries a center electrode 2. In the embodiment shown, the center electrode 2 comprises a plurality of ignition tips in order to produce a particularly large plasma volume and to thereby improve the ignition properties. Instead of a branched center electrode, it is also possible to use an unbranched center electrode, i.e. a simple pin.

The insulator 1 comprises a central bore through which the center electrode 2 is connected to a coil 3. The coil 3 is wound onto a bobbin 4 and is enclosed by a tube housing 5. The annular space between the coil 3 and the tube housing 5 is filled with insulating material 6, e.g. casting compound, coating, or insulating oil.

The insulator 1 is enclosed by a metallic outer conductor 7 which is connected in an electrically conductive manner to the tube housing 5. In the embodiment shown, the outer conductor 7 comprises a thread by way of which the ignition device can be screwed into an engine in the same manner as a conventional spark plug.

The outer conductor 7, together with the center electrode extending in the insulator 1 or a supply lead to the center electrode extending in the insulator 1, forms a capacitor which is connected in series to the coil 3 and forms an oscillating circuit.

The coil 3 tapers toward the insulator 1. The bobbin 4 carrying the coil 3 tapers toward the insulator 1. A cylindrical bobbin section adjoins the tapering section of the bobbin 4. The coil 3 encloses the cylindrical bobbin section and the tapering section.

Field peaks in the region of the coil end can be largely prevented by way of the particular shape of the coil 3. By way of an advantageously even distribution of the field lines it is therefore possible to markedly reduce the risk of voltage overloads and partial discharges.

A metal cap 8 is carried by an end section of the bobbin 4 facing the insulator 1. The metal cap 8 tapers toward the cap end facing away from the insulator. This means that the metal cap 8 tapers toward the coil 3. The tapering end section 8*a* of the metal cap 8 can have a conical shape, although a transition between a cylindrical section and a conical section should be rounded, in particular tangentially rounded.

The metal cap 8 can cover one or more windings on the end of the coil 3 or terminate in front of the coil 3. Preferably the metal cap 8 encloses a cylindrical section of the bobbin 4, as shown in FIG. 3 in particular. The metal cap 8 can be inserted particularly easily onto a cylindrical or slightly conical end section of the bobbin 4. In addition, the metal cap 8 can also cover a tapered section of the bobbin.

The metal cap 8 likewise contributes to the prevention of field peaks at the end of the coil 3. In this regard it is particularly advantageous when the outer diameter of the metal cap 8 diminishes toward the coil 3. It is advantageous in particular when the outer diameter of the metal cap 8 diminishes across a shorter section than the outer diameter of the coil 3 diminishes. For example, the metal cap 8 can taper across a length that is less than half as great as the length of the tapered section of the bobbin 4. It is advantageous in particular when the metal cap 8 tapers across a length that is between one-tenth and one-half, in particular one-fifth and one-half the length of the tapered coil section.

The section of the bobbin 4 tapering toward the insulator 1 should be enclosed by at least five, preferably at least ten, adjacently disposed windings of the coil 3. The section of the metal cap 8 tapering toward the coil 3 should have a length that is at least as great as the width of three, preferably at least five adjacently disposed windings of the coil 3.

The bobbin 4, in particular the tapered section of the bobbin 4, can comprise an electrically conductive surface. For example, the bobbin 4 can be made of plastic and can be metallically coated. The field distribution can be evened out further by way of an electrically conductive surface in the region of the tapered section of the bobbin 4.

In the embodiment shown, the maximum outer diameter of the metal cap 8 corresponds to the maximum outer diameter of the coil 3. This means that the maximum outer diameter of the metal cap 8 deviates from the maximum outer diameter of the coil 3 by less than 10%, and preferably less than 5%.

The coil 3 can be connected to the center electrode 2 by way of a contact sleeve 9. In the embodiment shown, the contact sleeve 9 is inserted into the insulator 1 and is connected in an electrically conductive manner to the metal cap 8. The contact sleeve 9 can be formed as a single piece with the metal cap 8, or can be connected as a separate part therewith during assembly, e.g. by way of a snap-in connection.

The metal cap 8 is adapted to the outer geometry of the winding of the coil 3 to optimize the field distribution. Edges and, therefore, field peaks are prevented in the ignition device depicted. Advantageously, narrow radii are not present. Tangential transitions between different radii of curvature are provided on the bobbin 4 and the metal cap 8.

REFERENCE NUMERALS

1 Insulator
2 Center electrode
3 Coil
4 Bobbin
5 Tube housing
6 Insulating material
7 Outer conductor
8 Metal cap
8*a* End section
9 Contact sleeve

What is claimed is:

1. An ignition device for igniting fuel in an internal combustion engine by producing a corona discharge, said ignition device comprising:

an insulator carrying a center electrode; and a coil connected to the center electrode, the coil being wound onto a bobbin, the bobbin comprising a tapering section with a reducing diameter as it approaches the center electrode, where the coil is enclosed by a tube housing, and where the coil tapers with a reducing diameter as it approaches toward the insulator and the center electrode by following the tapering section of the bobbin with the reducing diameter, where the tapering of the coil comprises at least more than one winding of the coil.

2. The ignition device according to claim 1, wherein the tapering section of the bobbin adjoins a substantially cylindrical bobbin section, surrounded by some windings of the coil.

3. The ignition device according to claim 1, wherein the tapering section of the bobbin comprises an electrically conductive surface.

4. The ignition device according to claim 1, wherein an end section of the bobbin facing the insulator carries a metal cap.

5. The ignition device according to claim 4, wherein at least one winding of the coil touches the metal cap.

6. The ignition device according to claim 4, wherein the metal cap covers at least one winding of the coil.

7. The ignition device according to claim 4, wherein the metal cap comprises a taper reducing in diameter as it moves towards the coil and the bobbin.

8. The ignition device according to claim 7, wherein the taper of the metal cap tapers across a length that is between one-tenth and one-half a length of the tapering section of the bobbin.

9. The ignition device according to claim 4, wherein an outer diameter of the metal cap corresponds to a maximum outer diameter of the coil.

10. The ignition device according to claim 1, wherein a section of the bobbin which tapers toward the insulator is surrounded by at least five windings of the coil.

11. An ignition device for igniting fuel in an internal combustion engine by producing a corona discharge, said ignition device comprising:

a center electrode having a proximal end and distal end, the distal end configured to be disposed within a combustion chamber;

an insulator surrounding the center electrode;

a bobbin disposed at the proximal end of the center electrode, the bobbin including a tapering section with a reducing diameter as it approaches the proximal end of the center electrode;

a coil wrapped around the bobbin following the tapering of the tapering section of the bobbin, where the coil is electrically coupled to the center electrode;

a housing surrounding the coil; and a metal cap disposed at an end of the tapering section of the bobbin and at an end of the coil, where the metal cap is circumferentially disposed about a portion of the bobbin.

12. The ignition device according to claim 11, wherein the metal cap comprises a tapered end, the tapered end reducing in diameter as it approaches the end of the coil.

13. The ignition device according to claim 12, wherein the metal cap is electrically coupled to the end of the coil.

* * * * *